United States Patent [19]

Bowman

[11] Patent Number: 4,963,053

[45] **Date of Patent: * Oct. 16, 1990**

[54] MULTICOMPONENT WALES AND BASES FOR MANHOLE COVER SUPPORTS

[76] Inventor: Harold M. Bowman, 18867 North Valley Dr., Fairview Park, Ohio 44126

[ * ] Notice: The portion of the term of this patent subsequent to Sep. 19, 2006 has been disclaimed.

[21] Appl. No.: 362,257

[22] Filed: Jun. 6, 1989

Related U.S. Application Data

[63] Continuation-in-part of Ser. No. 207,185, Jun. 15, 1988, Pat. No. 4,872,780, Ser. No. 207,266, Jun. 15, 1988, Pat. No. 4,867,601, Ser. No. 207,326, Jun. 15, 1988, abandoned, and Ser. No. 207,325, Jun. 15, 1988, abandoned, each is a continuation-in-part of Ser. No. 76,668, Jul. 23, 1987, Pat. No. 4,834,574.

[51] Int. Cl.[5] ..... E02D 29/14

[52] U.S. Cl. ..... 404/26; 52/20

[58] Field of Search ..... 404/25, 26, ; 52/19–21; 49/41, 466, 505

[56] References Cited

U.S. PATENT DOCUMENTS

| | | | |
|---|---|---|---|
| 1,908,909 | 5/1933 | Manz | 52/19 |
| 3,773,428 | 11/1973 | Bowman | 404/26 |
| 4,302,126 | 11/1981 | Fier | 404/26 |
| 4,582,450 | 4/1986 | Neil | 404/26 |
| 4,637,752 | 1/1987 | Centa | 404/25 |
| 4,834,574 | 5/1989 | Bowman | 404/26 |
| 4,867,601 | 9/1989 | Bowman | 404/26 |

OTHER PUBLICATIONS

One page from Spec. No. 715–713, N.Y. State Dept. of Transportation, Albany, N.Y., entitled "715–13 Prefabricated Adjustment Rings and Frames for Drainage Units and Manholes"–published prior to 1983.

*Primary Examiner*—Jerome W. Massie
*Assistant Examiner*—Matthew Smith
*Attorney, Agent, or Firm*—Watts, Hoffmann, Fisher & Heinke

[57] ABSTRACT

An improvement is shown in a manhole cover support having a metal body comprising a base portion with a peripheral ledge portion that projects inwardly, a lateral keeper portion that extends from the base and rises from the outer edge of the ledge portion, and a reinforcing wale that is substantially coextensive with the top of the keeper portion and projects outwardly therefrom, the wale and/or the base portion being box members. The improvement comprises having a substantial part of a box member constituted of at least one piece of metal that is distinct from the rest of the body structure and is attached thereto.

25 Claims, 2 Drawing Sheets

MULTICOMPONENT WALES AND BASES FOR MANHOLE COVER SUPPORTS

REFERENCE TO OTHER APPLICATIONS

This patent application is a continuation-in-part of applicant's: Ser. No. 07/207,185 filed on June 15, 1988, entitled Manhole Cover Support with Box Flanging U.S. Pat. No. 4,872,780; Ser. No. 07,207,266 filed on June 15, 1988, entitled Sturdy Adjustable Manhole Cover Support U.S. Pat. No. 4,867,601; Ser. No. 07/207,326 filed on June 15, 1988, entitled Manhole, Cover Support Having Enhanced Grip now abandoned; and Ser. No. 07/207,325 filed on June 15, 1988, entitled Manhole Cover Support Resistant to Water Infiltration now abandoned, all of these applications themselves being continuations-in-part of Ser. No. 07/076,668, filed on July 23, 1987, entitled Utility Cover Extension U.S. Pat. No. 4,834,574. The teachings of these applications are incorporated herein by reference.

BACKGROUND OF THE INVENTION

This invention relates to manhole cover supports for emplacing over and raising the effective grade of an existing manhole cover receiving structure such as the usual cast iron manhole cover frame, and more particularly to manhole cover supports having wales and/or base portions that are box members, especially those cover supports that are arcuate in plan.

For simplicity the term "existing manhole cover receiving structure" is used here to refer to the existing, i.e., fixed in-place frame or other seating receptacle for a removable cover or grating that covers an access hole (i.e., hand hole, tool hole, manhole, catch basin or the like). The term "manhole cover" is used to refer to the removable cover or grating over the access hole. The resulting assembly of a receiving structure and a manhole cover ordinarily is intended to bear vehicular traffic. The term "manhole cover support" or simply "cover support" here means a structure that fits over the existing manhole cover receiving structure, raises its grade, and thereby accommodates a cover or grating at the new elevated grade. The access hole covered is a utility enclosure serving, e.g., an electric, gas, water, sewer or storm drainage system.

Ordinarily the instant cover support finds its use when a roadway such as a street or highway is resurfaced with an added layer of paving material. Typically asphalt concrete is overlaid or repaved to establish a higher grade. It then is advantageous to mount the inventive cover support atop the existing manhole receiving structure. Prior art on manhole cover supports and manhole cover frames can be found in U.S. Pat. Nos. 4,281,944, 4,236,358, 3,968,600, 3,773,428, 4,097,171, 4,302,126, 3,891,337 and 1,987,502. The first four of these are for inventions of the applicant.

Axle loads up to 40,000 pounds must be resisted by many of these cover supports as well as serious impact loads from vehicles and snow plows, a variety of temperature effects, steam leaks, spillage, etc., without permitting a hazardous dislocation of the cover support or its cover. Often it is desirable also to cushion the cover a bit for resisting wear or reducing noise, or to seal the cover and its cover support against a substantial and possibly overloading infiltration of surface water, e.g., storm drainage that otherwise would enter a sanitary sewer system at various manhole locations. Adjustability of the cover support in peripheral dimension and height also is important for accommodating the wide range of specifications to be met.

Installing, adjusting, loading and unloading and otherwise handling manhole cover supports and removing the covers therefrom usually is done with powerful and indelicate tools such as picks, pinch bars, crowbars, tongs, heavy hooks and the like. Deformation of the cover support can occur, particularly about its upper edge which is nearest the road surface. Also, the upper edge usually is the handiest area for applying lifting and other tools. Deformations of the edge never are good, and they can render the opening of the support unfit for service. Hence, overall ruggedness and stiffness against deformation, especially at or near the top rim, and resistance to displacement are major concerns about manhole cover supports.

On the other hand, a relatively light construction of the cover support, in comparison to the ponderous cast iron frame that usually initially supports the manhole cover when the first paving is laid, can be very desirable, provided, however, that an inordinate amount of the ruggedness, stiffness, and resistance to displacement or dislodgement is not sacrificed. Usually a main place for weight reduction is in the lateral keeper for the cover. Another place is in the base of the cover support. Clearly, the economics of manufacture, handling and installation all are generally in favor of lower weight. A relatively thin wall keeper would normally be of steel, rarely no more than about 0.1 inch (12 ga.) thick, usually less.

The instant cover support is an improvement in a cover support with box members, particularly the support of Ser. No. 07/207,185, a parent application referred to above U.S. Pat. No. 4,872,780. That support combined a reasonably low overall weight with a desirable high degree of stiffness; the present improvement makes the support manufacturing, e.g. by cold forming, appreciably easier, and it provides a cover support wherein the metal does not need to be subjected to as much stretching, straining, and attendant thinning and possible deterioration, or the risk of a folding or crimping-in of metal around an inner periphery of the support.

Additionally, this improved cover support can be adapted readily like its parent support to be sealed off against water infiltration and to cushion the cover. It can be made adjustable in its outer perimeter if desired.

BROAD STATEMENT OF THE INVENTION

One aspect of the instant invention is an improvement in a manhole cover support for mounting on an existing manhole cover receiving structure and raising the effective grade thereof, the support having a metal body comprising a base portion with a peripheral ledge portion that projects inwardly, a lateral keeper portion that extends from the base and rises from the outer edge of the ledge portion, and a reinforcing wale that is substantially coextensive with the top of the keeper portion and projects outwardly therefrom, the wale and/or the base portion being box members. The improvement comprises having a substantial part of the box member constituted of at least one piece of steel that is distinct from the rest of the body structure and is attached thereto for completing the box configuration.

Another aspect of the instant invention is an improvement in process for making the metal body of an arcuate-in-plan manhole cover support, the body comprising a base portion with a peripheral ledge portion that projects inwardly, a lateral keeper portion that extends from the base and rises from the outer edge of the ledge portion, and a reinforcing wale that is integral with the top of the keeper portion and projects outwardly, the wale and/or the base portion being box members. The improvement comprises: forming a substantial part of each box member from at least one piece of metal sheet that is distinct from the rest of the body structure; and attaching said at least one piece onto the body for completing each box configuration.

BEST MODE FOR CARRYING OUT THE INVENTION

Figure 1A:
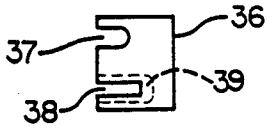
FIG. 1A shows the profile of the plug in elevation.
Figure 1:
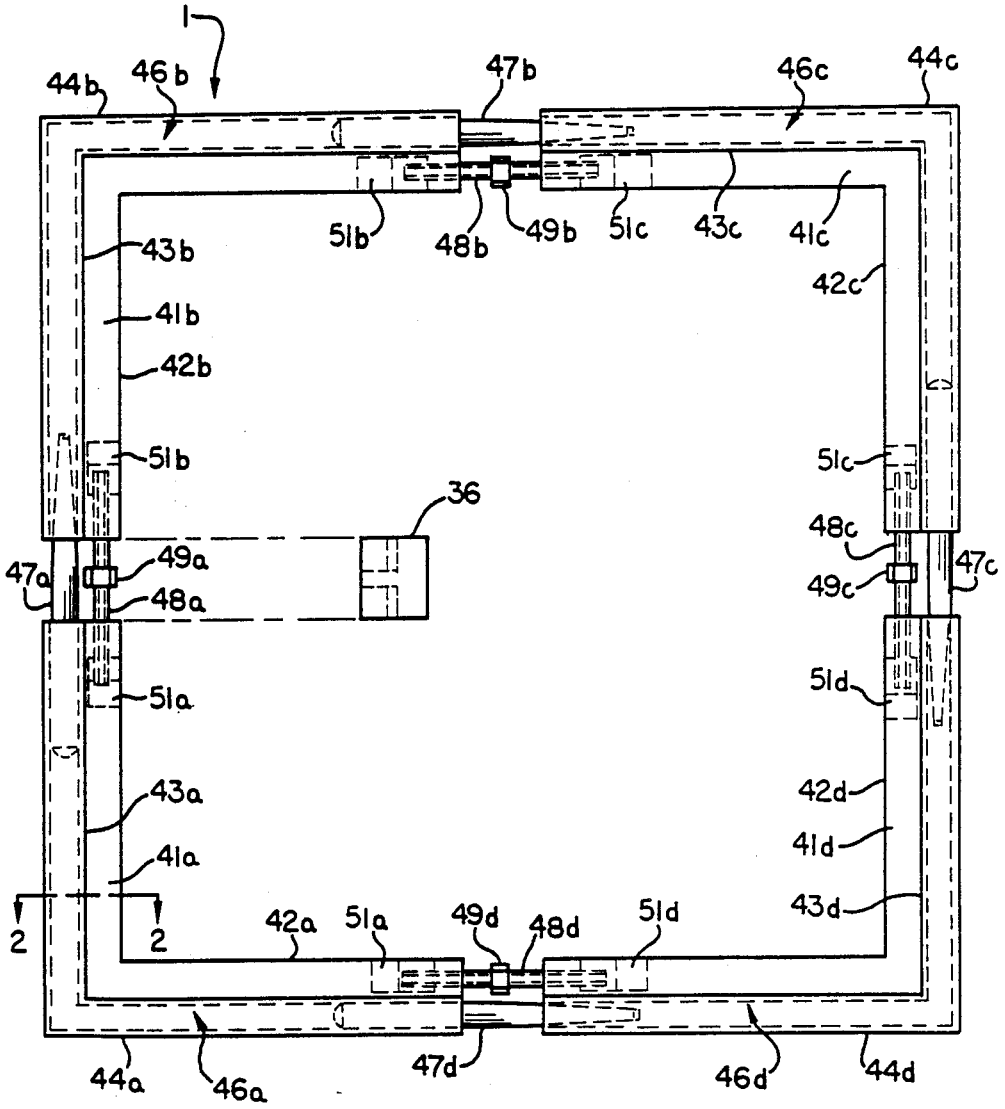
FIG. 1 is a plan view of a 4-segmented square expansible manhole cover support with turnbuckle spreader bolts at about the middle of each side of the resulting cover. A rubber plug for the left side joint is shown withdrawn to the right.
Figure 2:
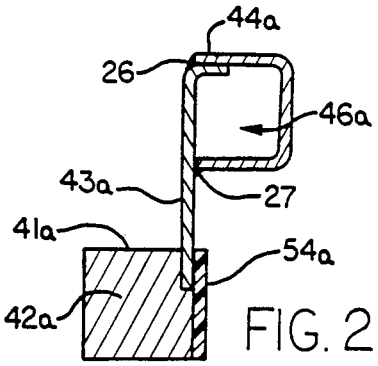
FIG. 2 is a cross sectional elevation, on an enlarged scale, taken through plane 2—2 of FIG. 1.

Reference is made to FIGS. 1, 1A and 2. Arrow 1 refers generally to the square cover support. Seat 41*a* is the top surface of the cast ductile iron (grade 60 -45-12 or 536) base portion 42*a* of the lower left quadrant of the cover support. In this form, the base portion 42*a* is of a solid construction. The vertical sheet steel keeper portion 43*a* rises from the base portion 42*a*. The bottom of the keeper portion 43*a* is welded to the base portion 42*a*. The keeper portion is of 13 gauge (0.09375") steel. The top edge of the keeper portion 43*a* is bent over to provide a short flange 45*a* (FIG. 2) beneath U-shaped channel 44*a*, a 13-gauge sheet steel piece. The ends of channel 44*a* are welded by welds 21 and 22 to the keeper portion 43*a* to form a hollow wale portion 46*a*.

Turnbuckle bolt 48*a* is operated by wrench grip 49*a* to widen or narrow the gap between this lower left segment and the one shown above it. As the four quadrants of this cover support device are symmetrical, the numbers of like parts of each quadrant are given the same arabic numerals all around and are distinguished from each other only by lower case letter subscripts. Also crossing this gap is tapered steel shaft 47*a*. Its untapered end is welded into wale 40*a*. The tapered end of shaft 47*a* fits slidably into the hollow wale portion 46*b*.

One of the threaded ends of turnbuckle bolt 48*a* projects directly into the upper end of base portion 42*a*, entering at a bevelled-off-at-the-bottom entrance to the base segment. The bolt can extend into recess 51*a* in the bottom of that base portion. The other threaded end of turnbuckle bolt 48*a* i of opposite thread. It projects directly into the lower end of the base portion 42*b*, and it can extend into recess 51*b* therein.

Soft rubber plug 36, notched on its upper left side for shaft 47*a* and below that for turnbuckle bolt 48*a* and nut 49*a*, is shown withdrawn from the gap between the two left side segments. The other three joints have like plugs, not shown, for stopping the entrance of water at the joints. In FIG. 1A the notching is more evident in profile. Thus, plug 36 has upper notch 37 for shaft 47*a*, notch 38 for bolt 48A and recess 39 in notch 38 for the nut 49*a*. The plug can be cut to width after expanding the cover support into place, then tapped into position. In place of plugs, one can fill the joints with a plastic foam comprising a polymer, which foam expands, gels and dries in place into a flexible solid after having been dispensed as a fluent material into the cavity of a joint.

In FIG. 2 an ⅛" thick frictional retention member portion 54*a* is visible. It adheres to the outside of the base section 42*a*. Member portion 54*a* is peripheral to the base section 42*a* and is of a tough vinyl plastisol. A cushioning and sealing layer of like material can be deposited all over seat portions 41*a*, 41*b*, 41*c* and 41*d*, if desired.

Figure 3:
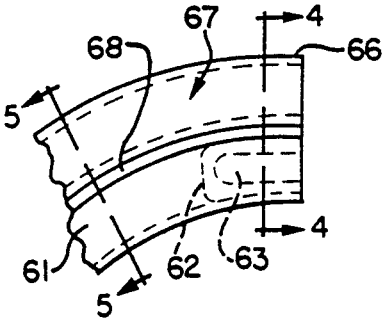
FIG. 3 is a fragmentary plan view of one end of a round split ring cover support that can have a tapered steel shaft connecting the two ends of its box member wale portion and a spreader screw in a tapped plug end of its box member base portion. A projecting screw head (not shown) acts against the opposing plugged end (not shown) of such base portion.
Figure 4:
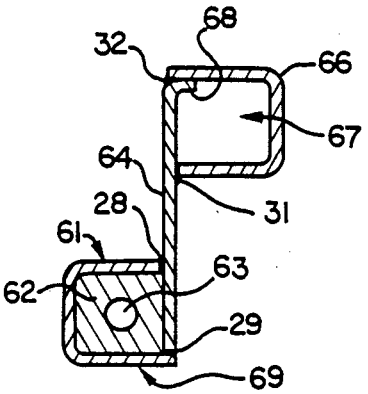
FIG. 4 is a vertical cross section on an enlarged scale, taken through plane 4—4 of FIG. 3.
Figure 5:
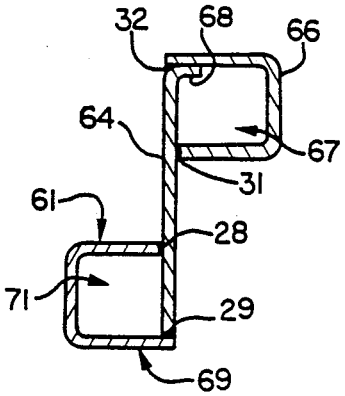
FIG. 5 is a vertical cross section, on an enlarged scale, taken through plane 5—5 of FIG. 3, and FIGS. 6, 7 and 8 are fragmentary vertical cross sections of various wales alternative to the one depicted in FIG. 2.

Referring to FIGS. 3, 4 and 5, the arcuate end of a fragment of a split ring cover support is shown in plan view in FIG. 3. An iron plug 62, with threaded hole 63, is welded into the end of the base under seat 61. Apart from its plugged ends, the base under seat 61 is hollow, being formed of 14-gauge sheet steel by the generally U-shaped arcuate channel 69 welded at its free ends, as at 28 and 29, onto the inside and bottom of the sheet steel riser member 64 of like gauge. The annular wale 66 is also hollow, being formed of a generally U-shaped 14-gauge sheet steel channel welded to the bent-over flange 68 at the top of riser 64 and to the outside of the riser 64 somewhat below the top with welds 31 and 32.

The pair of adjacent ends of the split ring wale can be bridged, if desired by a rod or flange (not shown) extending out of hollow space 67 and into the corresponding space of the adjacent end of the wale. The threaded hole 63 is to accept a spreader screw (not shown) that can operate across the gap with its head (not shown) against a welded-in iron plug reaction member (not shown) in the other end of the split ring base, that other end not being shown.

FIG. 5 shows the vertical cross section C—C through FIG. 3. It illustrates the box member base and wale as described in connection with FIG. 4, except that the interior of the base under seat 61 contains no iron plug.

Figure 7:
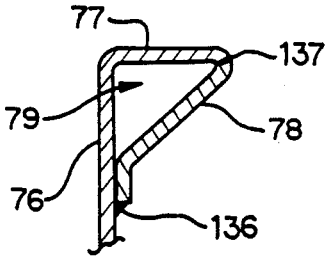
Figure 6:
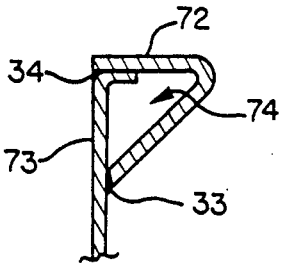
Figure 8:
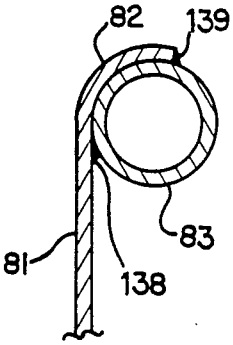

FIGS. 6, 7 and 8 show the vertical cross sections of modifications of wales that can be used in a structure like that of FIG. 3. Thus, in FIG. 6 the wale is made by welding angular sheet steel piece 72 to bent-top riser 73 with welds 33 and 34 to form an annular hollow wale 74; the wale is substantially triangular in vertical cross section. In FIG. 7 angular steel piece 78 is welded to riser 76 and its flanged top 77 by welds 136 and 137 to provide hollow wale 79. In FIG. 8 an annular tubing 83 is welded, as at 138 and 139, to the riser 81 and its bent top 82. The riser 76 has a bent-over top flange 82 that conforms to about a third of the exterior of tubing 83.

While the cover support embodiments depicted are for circular and square holes, it is contemplated that rectangles, triangles, ovals, etc. also are possible shapes for cover supports in accordance with invention principles. If the supports are to be rendered adjustable as to their perimeter, usually turnbuckle means are used at the joints. Attaching of distinct steel pieces to iron or steel here preferably is done by welding the parts together. However, other attaching methods can be used, e.g. brazing, soldering, riveting and/or bolting.

Suitable polymers that can be formulated for use in the compressible retention component and for water seals herein include natural and synthetic rubbers, cork compounds, water resistant ionomers various vinyl polymers and copolymers such as polyvinyl acetate-polyethylene-acrylate copolymers and polyvinyl chloride homopolymers, polyurethanes, polesters resins, epoxy resins, styrene-containing copolymers such as ABS and butadiene-styrene or isoprene-styrene copolymers, polyolefins and copolymers containing olefin units, and aminoplasts. Plasticizers, pigmentation stains and/or mineral fillers such as talc, carbon black, etc. commonly are employed in their recipes. The best retention components appear to be elastomeric. Many of them can be foamed and preferably are foamed only very slightly; this can soften them a bit, and it makes them slightly less dense than without the foaming. Latent foaming agents reactive upon warming and/or catalyzing a film of an uncured polymer-providing material coated on a cover support are preferred. Curing the polymer-containing with heat, ultraviolet or electron beam radiation and/or catalysis can be practiced.

Customarily, it is of advantage to prime the metal with a bonding agent or use a bonding treatment to secure the best bond of the retention component or a water sealing element to metal. Some polymers can bond well without this, e.g., epoxy resins. However, the bonds of most are improved by such priming and/or treating.

A preferred foamed plastisol for the retention component is of Shore A Durometer hardness about 20-70, and preferably about 50-65, as are the water seals. The plastisol is compounded principally from low molecular weight polyvinyl chloride resin plasticized heavily with a conventional phthalate ester plasticizer. It contains minute percentages of stabilizer, red pigment and ozodicarbonamide blowing agent. Another preferred formulation of about the same Shore A Durometer hardness is a flexible polyolpolyurethane foam, slightly elastomeric and rubbery. Some polymer recipes need heat to cure and foam, even with catalysis, and others cure and even foam at about room temperature (78° F.). The degree of foaming in both these plastisol and urethane formulations is very small, and it could be called almost microscopic and slight—the bubbles are closed-cell and tiny. In some cases, especially where sealing is be maximized and strength considerations are secondary, a fair amount of foaming and a resulting softened and less dense foamy structure can be tolerated, e.g., A Shored Durometer hardness of 20-55.

The preferred foamed plastisol usually is sprayed on the area to be coated. It is advantageous to spray it onto the hot metal cover support body (370°-380° F.) and let it cure (harden and toughen) and foam a bit. If extra foaming and/or curing is desired, the coated part can be further warmed at 380°-400° F. up to a few minutes. Thickness of the retention element must be between about 0.4 and 400 mils to take care of, on the thinner side, minor surface irregularities while, on the thicker side, neither rendering the seat of the cover support too constricted to accept the same cover that was used for the existing cast iron frame (or other cover-seating receptacle) nor in metal-to-metal bearing surface between its base and the seat of that existing frame.

Metal surfaces should be cleaned to accept the polymeric material if it is to be bonded to the metal. Then a customary bonding agent such as Chemlok #218 (Manufactured by Lord Corporation, Erie, Pa.) is applied, dried and warmed. Various other useful bonding agents are available such as a Pliobond type (made by the Goodyear Tire and Rubber Company).

As shown above, the preferred materials of construction for most of the cover support, i.e., the body and various elements of the body, are of a ferrous metal, e.g., steel and/or cast irons, particularly cast ductile iron. Other metals can be used where their special properties are desirable an their cost can be tolerated), e.g., stainless steel, high tensile strength steel, wrought iron, bronze, brass etc. Desirably screw threads will have nylon locking patches.

Many modifications and variations of the invention will be apparent to those skilled the art in the light of the foregoing detailed disclosure. Therefore, it is to be understood that, within the scope of the appended claims, the invention can be practiced otherwise than as shown and described.

What is claimed is:

1. In a manhole cover support for mounting on an existing manhole cover receiving structure and adapted for raising the effective grade thereof, the cover support having a metal body comprising a base portion having a peripheral ledge portion that projects laterally inwardly, a lateral keeper portion that extends from the base portion and rises upwardly from the outer edge of said ledge portion, a reinforcing wale portion having hollow construction formed by at least one discrete piece of metal joined to the keeper portion and projecting outwardly therefrom, the wale portion being spaced vertically from the base portion.

2. The manhole cover support in accordance with claim 1, wherein said base portion is of a hollow construction, and the body is mainly of sheet steel.

3. The manhole cover support in accordance with claim 1, wherein said base portion is of a solid construction.

4. The manhole cover support of claim 3 wherein the base portion is of cast ductile iron.

5. The manhole cover support of claim 1 wherein the body is arcuate in plan.

6. The manhole cover support of claim 1 wherein the body has at least one joint equipped with spreader means for rendering the body adjustable in peripheral dimension.

7. The manhole cover support of claim 6 wherein the body is in the form of a split ring.

8. The manhole cover support of claim 6 wherein the body is made of a plurality of joined segments.

9. The manhole cover support claim 1 wherein the wale portion is essentially polygonal in vertical cross section.

10. The manhole cover support of claim 9 wherein the wale portion is substantially rectangular in vertical cross section.

11. The manhole cover support of claim 1 wherein at least part of the wale portion is arcuate in vertical cross section.

12. The manhole cover support of claim 1 wherein the base portion is essentially rectangular in vertical cross section.

13. The manhole cover support of claim 1 wherein there is a frictional retention component that is disposed around the outside of the base portion of the body.

14. The manhole cover support of claim 13 wherein the retention component adheres to the outside of the base portion of the body.

15. In a manhole cover support having an arcuate ferrous metal body comprising a cast iron base portion that is arcuate in plan with a peripheral ledge that projects inwardly, a sheet steel keeper portion that extends from the base and from the outer edge of the ledge portion, and a reinforcing wale portion that is integral and substantially coextensive with the top of the keeper portion, is substantially coextensive with the top of the keeper portion, and projects outwardly, the wale portion being a steel box member that is polygonal in cross section, the improvement which comprises having a substantial part of the wale portion constituted of at least one piece of sheet steel that is distinct from the rest of wale portion and is welded thereto for completing box configuration.

16. The manhole cover support of claim 15 wherein the body has at least one joint equipped with spreader means for rendering the body adjustable in peripheral dimension and creating a gap therein.

17. The manhole cover support of claim 16 wherein the body is made of a plurality of joined segments.

18. The manhole cover support of claim 16 wherein the spreader means includes a turnbuckle.

19. The manhole cover support of claim 15 wherein the cross section of the wale portion is substantially rectangular.

20. The manhole cover support of claim 16 wherein there are: a retention component comprising a layer comprising polymer, the layer being substantially thinner than the thickness of the cross section of the base portion of the body, the retention component adhering to and substantially completely covering the outside of the base portion of the body; and deformable plug means comprising polymer for sealing the gaps in the body from the substantial leakage of water through the gaps.

21. The manhole cover support of claim 20 wherein the plug means comprises an initially fluent composition comprising a settable polymeric foam.

22. The manhole cover support of claim 20 wherein the plug means comprises a preformed plug comprising a polymer.

23. In a process for making metal body of an arcuate-in-plan manhole cover support, the body comprising a base portion with a peripheral ledge portion that projects inwardly, a steel lateral keeper portion that extends from the base and rises from the outer edge of the ledge portion, a reinforcing wale portion that is integral with the of the keeper portion and projects outwardly, the wale and/or the base portions being steel box members, the improvement which comprises: forming a substantial part of each said box member of at least one piece of metal that is distinct from the rest of the body structure, and attaching said at least one piece onto the body for completing each box configuration.

24. The process of claim 23 wherein the body has at least one joint equipped with spreader means for rendering the body adjustable in peripheral dimension, the base portion is cast malleable iron, and the cross section of the wale is polygonal and the attaching is done by welding.

25. The process of claim 23 the body has at least one joint equipped with spreader means for rendering the body adjustable in peripheral dimension, both the wale and the base are steel box members having cross sections are essentially rectangular, and the attaching is done by welding.

* * * * *